US006435373B1

(12) United States Patent
Mizrahi

(10) Patent No.: US 6,435,373 B1
(45) Date of Patent: Aug. 20, 2002

(54) CAULKING GUN AND CARTRIDGE STRUCTURE

(76) Inventor: Shalom Mizrahi, 246 Lawrence St., Trumbull, CT (US) 06611

( * ) Notice: Subject to any disclaimer, the term of this patent is extended or adjusted under 35 U.S.C. 154(b) by 0 days.

(21) Appl. No.: 09/670,037

(22) Filed: Sep. 26, 2000

Related U.S. Application Data

(60) Provisional application No. 60/158,057, filed on Oct. 7, 1999.

(51) Int. Cl.[7] ..... B67D 35/56

(52) U.S. Cl. ..... 222/105; 222/95; 222/327; 222/391

(58) Field of Search ..... 222/95, 105, 326, 222/327, 391, 107

(56) References Cited

U.S. PATENT DOCUMENTS

| | | | | | |
|---|---|---|---|---|---|
| 2,853,209 | A | * | 1/1958 | Mcardle | 222/107 |
| 4,022,355 | A | * | 5/1977 | Sabaka | 222/327 |
| 5,301,835 | A | * | 4/1994 | Fulks et al. | 222/95 |
| 5,368,206 | A | * | 11/1994 | Sandrin | 222/326 |
| 6,223,941 | B1 | * | 5/2001 | Nealey | 222/82 |

* cited by examiner

*Primary Examiner*—Henry C. Yuen
*Assistant Examiner*—Melvin A. Cartagena
(74) *Attorney, Agent, or Firm*—Evelyn M. Sommer

(57) ABSTRACT

A caulking gun has a conventional tubular-shaped cartridge holder with a ratchet mechanism and ratchetable piston, and is used with a collapsible cartridge having a nozzle end, a hollow tubular body joined to the nozzle end having walls made of a semi-rigid deformable plastic material, and a rigid push in end sealed to the walls of the tubular body at the end opposite the nozzle end having a shape which pushes the tubular body walls ahead of it to a collapsed condition to squeeze sealant material out through the nozzle end when the push-in end is pushed by the piston of the caulking gun. In a preferred embodiment, the collapsible cartridge is used with a sleeve member which is inserted and retained in the cartridge holder of the caulking gun. The sleeve member has a removable retainer portion, a tubular holder body, and a displaceable portion which is pushed by the piston of the caulking gun. With the retainer portion removed, a new cartridge is inserted in the tubular body of the sleeve member, then the retainer portion is re-attached and the sleeve member is inserted in the cartridge holder. The caulking gun is operated in the conventional manner to push the push-in end of the cartridge to dispense sealant. When the cartridge is spent, it can be removed from the sleeve member without any soiling of the caulking gun, the user's hands, or exposed surfaces.

8 Claims, 6 Drawing Sheets

CAULKING GUN AND CARTRIDGE STRUCTURE

SPECIFICATION

This application claims priority of Provisional Application Ser. No. 60/158,057 filed Oct. 7, 1999.

TECHNICAL FIELD

This invention generally relates to a caulking gun and cartridge structure, and more particularly, to a modified caulking gun and improved, cleanly disposable cartridge structure.

BACKGROUND OF INVENTION

Caulking guns are widely used in the construction and home improvement industries to apply epoxy or resin-based caulking compound or sealant from standard sized cartridges into joints, seams, holes, etc. The standard type of caulking gun has a tubular-shaped cartridge holder portion into which a cartridge is inserted, a piston on the end of a ratchetable rod, a handle supporting the cartridge holder portion, piston and rod, and a ratchet mechanism, and a manually-actuated trigger which ratchets the rod and piston into the cartridge holder portion. The standard cartridge has a nozzle end, a hollow tubular body filled with sealant material to be dispensed, and a displaceable wall at its rear end- which is pushed into the hollow tubular body by the caulking gun's piston in a telescoping fashion in order to squeeze sealant material out through the nozzle end of the cartridge.

However, with this conventional type of caulking gun and standard cartridge, residue material left on the walls of the cartridge's tubular body as the displaceable wall is pushed toward the nozzle end can soil the piston portion and/or gum up the ratchet mechanism of the caulking gun. When the user removes the spent cartridge from the holder by hand, the residue material from the exposed cartridge end can soil the user's hands and cause spurious dabs of sealant material to be deposited on and harden on exposed surfaces. The present invention seeks to overcome the disadvantages of the conventional caulking gun and cartridge by providing improved structures which allow spent cartridges to be cleanly disposed of and prevent soiling of the user's hands and exposed surfaces.

SUMMARY OF INVENTION

In accordance with the present invention, a caulking gun, of the type having a tubular-shaped cartridge holder with a ratchet mechanism and ratchetable piston, employs a collapsible cartridge comprising a nozzle end, a hollow tubular body joined to the nozzle end having walls made of a semi-rigid deformable plastic material, and a rigid push-in end sealed to the walls of the tubular body at the end opposite the nozzle end having a shape which pushes the tubular body walls ahead of it to a collapsed condition to squeeze sealant material out through the nozzle end when the push-in end is pushed by the piston of the caulking gun.

In a preferred embodiment of the present invention, the collapsible cartridge is used with a sleeve member which is inserted and retained in the cartridge holder of the caulking gun. The sleeve member has a removable retainer portion, a tubular holder body, and a displaceable portion which is pushed by the piston of the caulking gun. With the retainer portion removed, a new cartridge can be inserted in the tubular body of the sleeve member, then the retainer portion is re-attached and the sleeve member is inserted in the cartridge holder. The caulking gun is operated in the conventional manner to push the push-in end of the cartridge and dispense sealant material therefrom. When the cartridge is spent, it can be removed from the sleeve member without any soiling of the caulking gun, the user's hands, or exposed surfaces.

Other objects, features, and advantages of the present invention will be explained in the following detailed description of the invention having reference to the appended drawings.

DETAILED DESCRIPTION OF INVENTION

Figure 1:
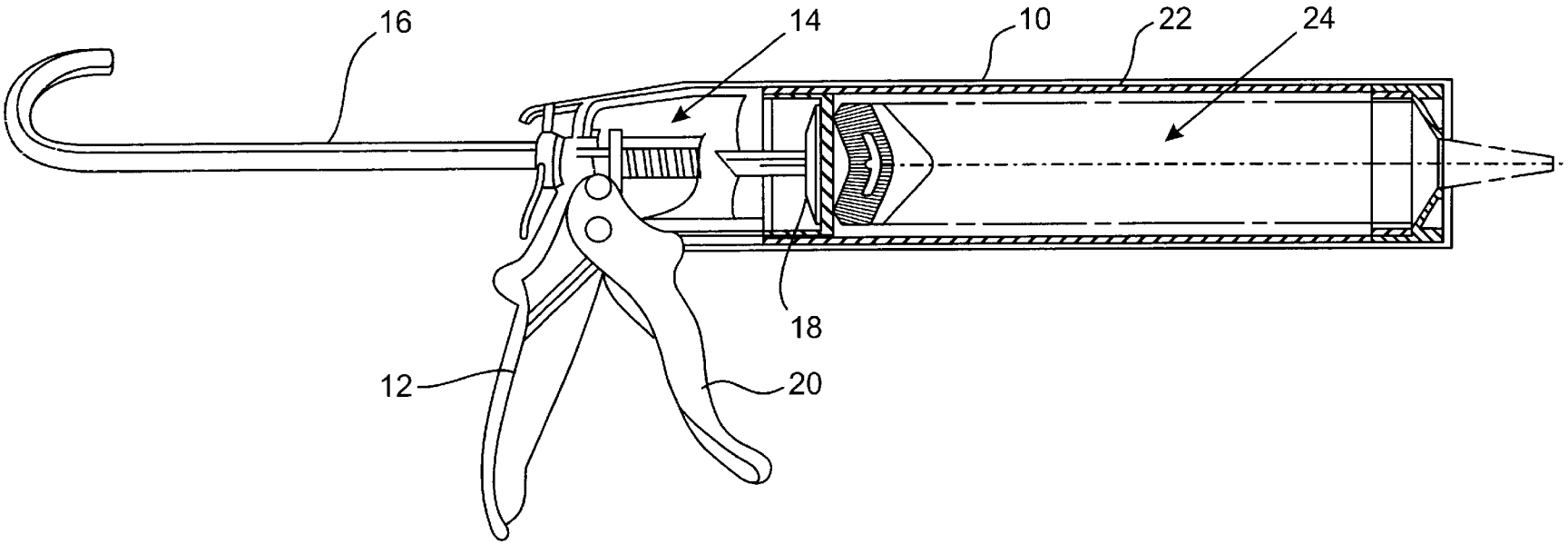
FIG. 1 illustrates an improved caulking gun with sleeve member and collapsible type cartridge in accordance with the invention.

In FIG. 1, a caulking gun in accordance with the present invention has the tubular-shaped cartridge holder 10, handle 12, ratchet mechanism 14, and ratchetable rod 16 and piston 18 in common with conventional caulking guns. Manual actuation of the trigger 20 repeatedly causes the ratchet mechanism 14 to ratchet the rod 16 and the piston 18 into the cartridge holder 10. With the conventional cartridge, a displaceable wall at its rear end is pushed by the piston into the cartridge's hollow tubular body in a telescoping fashion in order to squeeze sealant material out through the nozzle end. However, in the present invention, a collapsible type cartridge 24 is retained in a sleeve member 22 which is inserted in the cartridge holder 10 of the caulking gun. The sleeve member and collapsible type cartridge have an improved construction as described below.

Figure 2A:
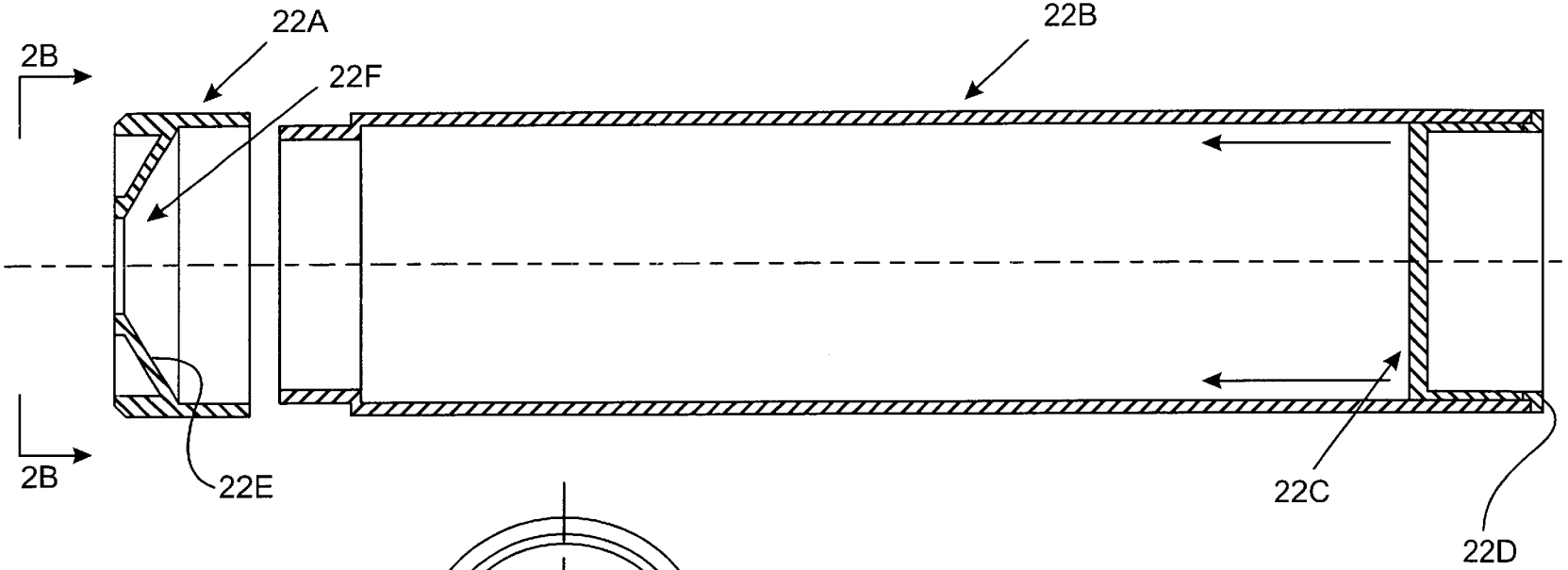
FIGS. 2A and 2B are detailed side and front sectional views of the sleeve member used in the caulking gun.
Figure 2B:
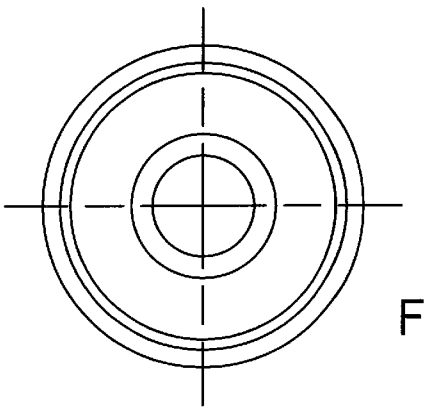

In FIGS. 2A and 2B, the sleeve member 22 is shown composed of a removable (threaded) retainer portion 22*a*, a hollow tubular sleeve body 22*b*, and a displaceable portion 22*c* which can be pushed by the piston of the caulking gun in telescoping fashion into the sleeve body 22*b*. The displaceable portion is kept from falling out the back end of the sleeve body 22*b* by an annular rim 22*b* which is bonded to the rear end of the sleeve body. The retainer portion 22*a* has inclined walls 22*e* against which the cartridge nozzle front walls are abutted, and a central opening 22*f* for the nozzle end of the cartridge to project through.

Figure 3:
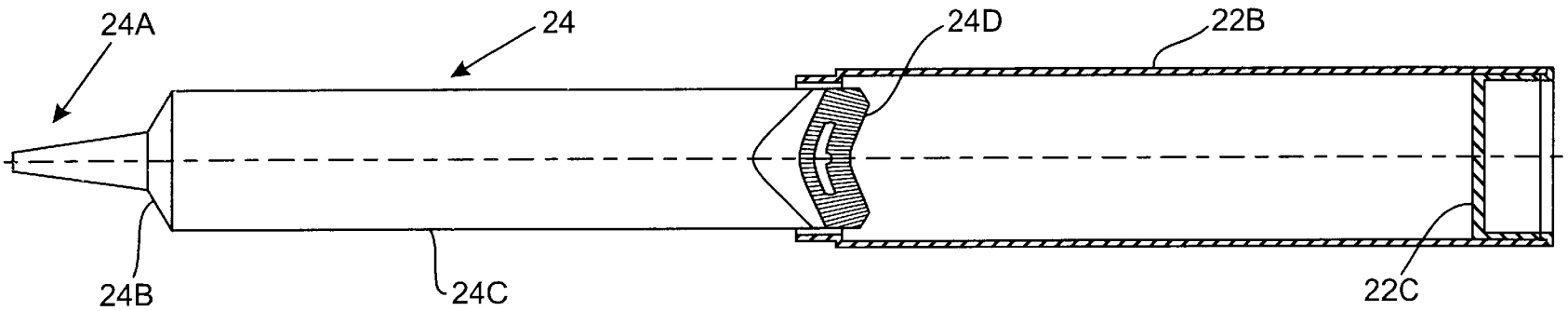
FIG. 3 illustrates the collapsible type cartridge and its loading into the sleeve member of the caulking gun.

In FIG. 3, the collapsible type cartridge 24 in accordance with the invention is shown having a nozzle end 24*a*, inclined front walls 24*b* which abut against the inclined walls 22*e* of the sleeve member, hollow tubular body 24*c*, and a push-in end 24*d* which seals the rear end of the tubular body. A new cartridge filled with sealant material is loaded into the unthreaded front end (with retainer portion removed) of the sleeve member 22 and slided back until the push-in end 24*d* abuts against the displaceable portion 22*c* of the sleeve member.

Figure 4A:
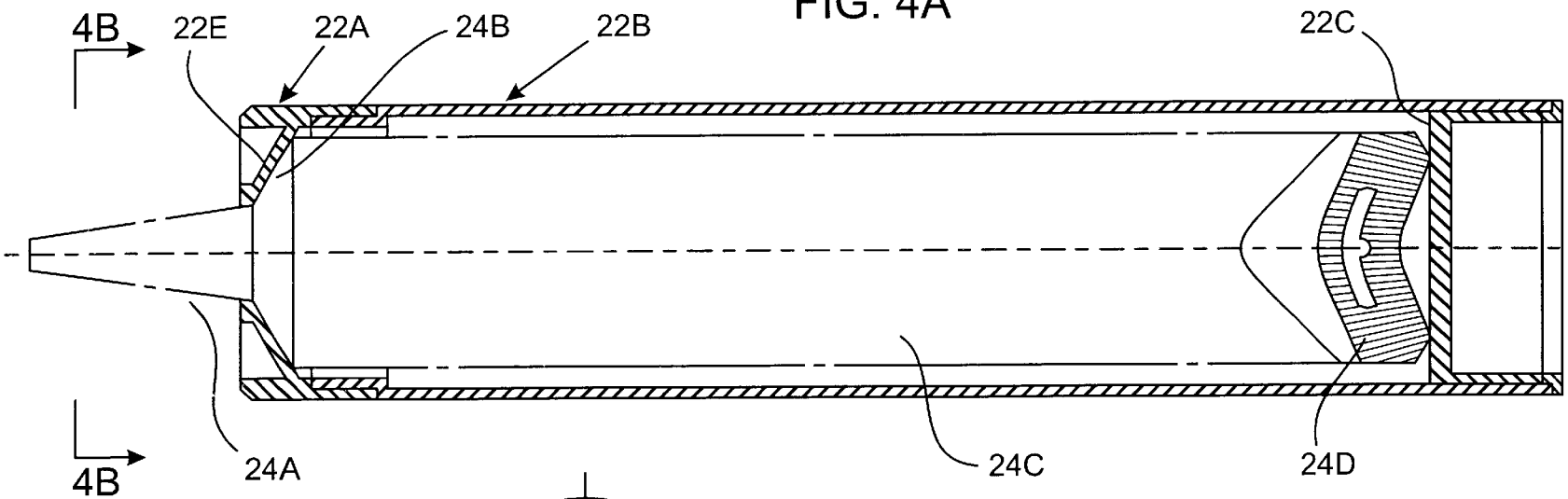
FIGS. 4A and 4B are detailed side and front sectional views of the collapsible type cartridge loaded in the sleeve member of the caulking gun.
Figure 4B:
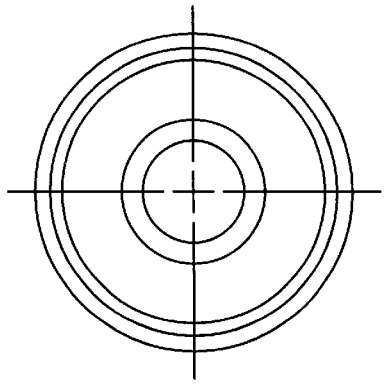
Figure 5A:
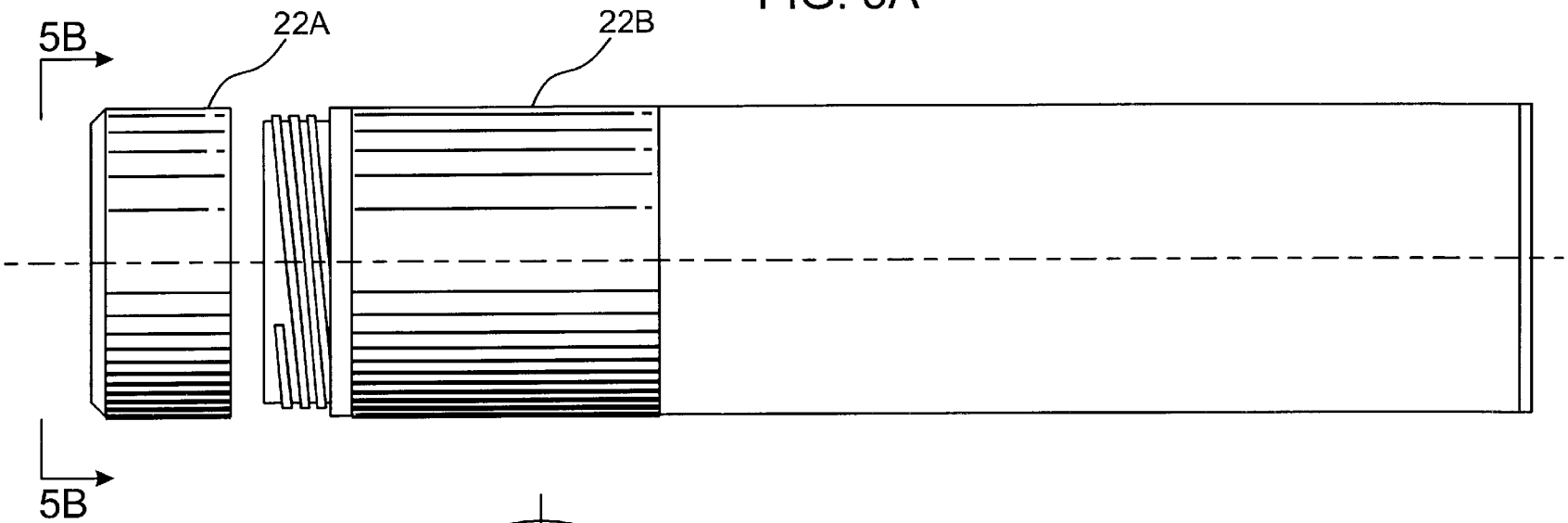
FIGS. 5A and 5B are detailed side and front sectional views of the threaded retainer portion of the sleeve member used in the. caulking gun.
Figure 5B:
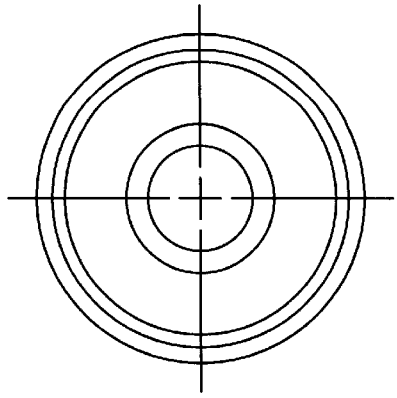

FIGS. 4A and 4B show the collapsible type cartridge loaded in the sleeve member and retained therein by the retainer portion 22*a*. FIGS. 5A and 5B show the threaded retainer portion of the sleeve member used in the caulking gun. The sleeve member loaded with a new cartridge can then be inserted in the cartridge holder of the conventional caulking gun structure and used to dispense sealant in a conventional manner.

The collapsible cartridge has its hollow tubular body made of a semi-rigid deformable plastic material, such as polyvinyl chloride (PVC) or polyethylene (PE) material. The push-in end 24*d* is sealed to the walls of the tubular body at the end opposite the nozzle end. It is made of a rigid material, such as heavy gauge PVC, and has a shape which facilitates its push-in on the tubular body walls ahead of it to a collapsed condition in order to squeeze sealant material out through the nozzle end of the cartridge. The preferred shape is an arrow shape which tends to cause collapsing from the center of the tubular body outwardly to the sides. In this manner, the push-in end causes the deformable plastic walls of the cartridge's tubular body to collapse like a spring being compressed, when the push-in end is pushed by the piston of the caulking gun.

Figure 6A:
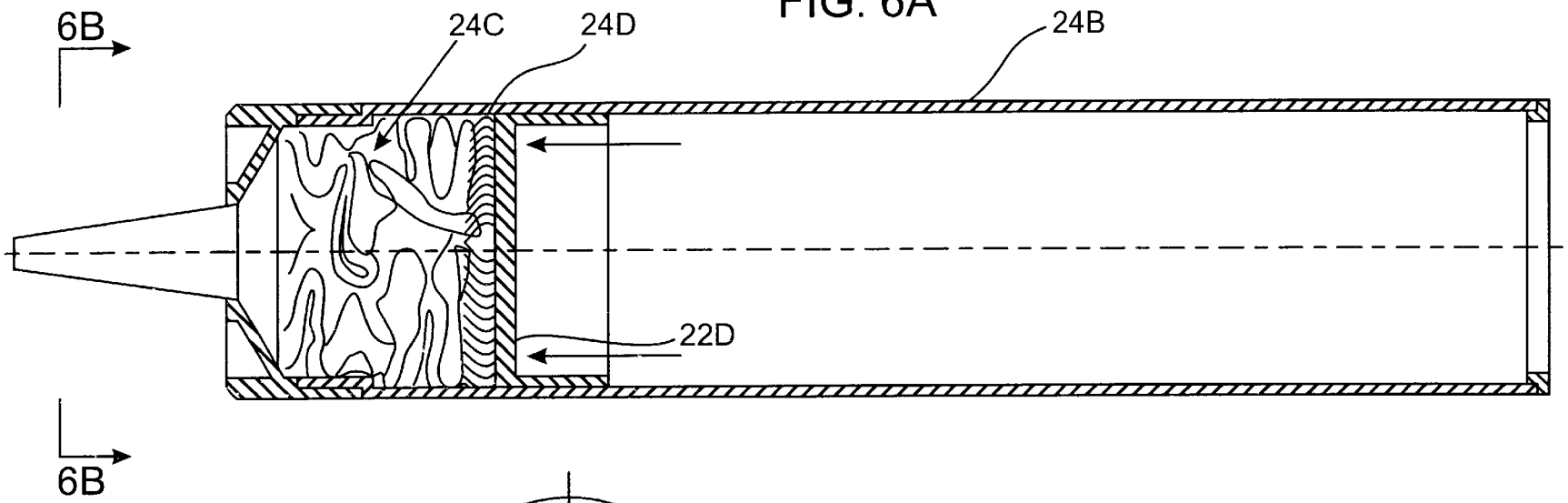
FIGS. 6A and 6B are detailed side and front sectional views showing the cartridge in collapsed condition in the sleeve member of the caulking-gun.
Figure 6B:
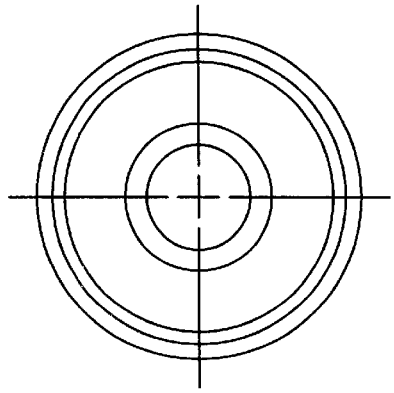

In FIGS. 6A and 6B, the deformable walls of the cartridge are shown in collapsed condition when the displaceable portion 22*c* of the sleeve member has been advanced by the piston substantially to the front end of the cartridge holder. The spent cartridge can be removed from the sleeve member by first retracting the piston 18, removing the sleeve member 22 from the cartridge holder 10, unthreading the retainer portion 22*a*, and removing the collapsed cartridge tube 24 therefrom. Since the walls of the cartridge tube have not been penetrated, the residue sealant remains contained within the tube walls, and will not soil the caulking gun, the user's hands, or exposed surfaces.

Different embodiments may be modified given the above description of the principles of the invention. It is intended that the described embodiments and modifications be included within the scope of the invention, as defined in the following claims.

I claim:

1. A caulking gun used in combination with a cartridge comprising:

the caulking gun having a tubular-shaped cartridge holder with a front wall at a front portion of the cartridge holder for retaining a cartridge provided with an opening for projecting a cartridge nozzle therethrough, and a ratchet mechanism and ratchetable piston provided at a rear portion of the cartridge holder for exerting ratchetable pressure on a cartridge loaded therein;

a rigid tubular sleeve member for holding a collapsible cartridge loaded with sealant material therein adapted to be inserted with the collapsible cartridge in said cartridge holder of the caulking gun; and a collapsible cartridge inserted in and constrained by the tubular sleeve member having a nozzle end, a hollow tubular body joined to the nozzle end having walls made of a semi-rigid deformable plastic material, and a rigid push-in end sealed to rear walls of the tubular body at a rear end opposite the nozzle end, wherein said rigid push-in end has an arrow shape that pushes on the rear walls of the tubular body to cause collapsing first along a centerline of the tubular body then outwardly to the sides of the tubular body, thereby readily pushing the tubular body walls ahead of it to a collapsed condition to squeeze sealant material out through the nozzle end when the push-in end is pushed by the piston of the caulking gun.

2. A caulking gun and cartridge combination according to claim 1, said sleeve member having a removable retainer front portion, a tubular holder body, and a displaceable rear portion which is pushed by the piston of the caulking gun when the sleeve member is inserted in the cartridge holder.

3. A caulking gun and cartridge combination according to claim 2, wherein the retainer portion is threaded on a threaded front end of the sleeve member.

4. A caulking gun and cartridge combination according to claim 2, wherein the displaceable portion is retained in the hollow tubular body of the sleeve member by an annular rim attached to the rear end of the tubular body.

5. A caulking gun and cartridge combination according to claim 1, wherein the push-in end of the collapsible cartridge is made of high gauge polyvinyl chloride plastic.

6. A cartridge, for use with a caulking gun of the type having a cartridge holder with a ratchet mechanism and ratchetable piston, and a rigid tubular sleeve member in which the cartridge loaded with sealant material is inserted and constrained when used in the cartridge holder, comprising:

a nozzle end for dispensing material contained in the cartridge therefrom;

a hollow tubular body joined to the nozzle end having, walls made of a semi-rigid deformable plastic material; and a rigid push-in end sealed to rear walls of the tubular body at a rear end opposite the nozzle end, wherein said rigid push-in end has an arrow shape that pushes on the rear walls of the tubular body to cause collapsing first along a centerline of the tubular body then outwardly to the sides of the tubular body, thereby readily pushing the tubular body walls ahead of it to a collapsed condition to squeeze sealant material out through the nozzle end when the push-in end is pushed by the piston of the caulking gun.

7. A caulking cartridge according to claim 6, used in combination with a sleeve member which is inserted and held in the cartridge holder of the caulking gun, said sleeve member having a removable retainer front portion, a tubular holder body, and a displaceable rear portion which is pushed by the piston of the caulking gun, wherein said collapsible cartridge is inserted-in and held by said sleeve member.

8. A caulking cartridge according to claim 6, wherein the push-in end of the collapsible cartridge is made of high gauge polyvinyl chloride plastic.

* * * * *